United States Patent [19]

McShane

[11] 4,021,066

[45] May 3, 1977

[54] PNEUMATIC DOOR LOCKING SYSTEM

[76] Inventor: James R. McShane, 4250 Saratoga Ave., Downers Grove, Ill. 60515

[22] Filed: July 11, 1975

[21] Appl. No.: 595,043

[52] U.S. Cl. ..... 292/144; 292/DIG. 32

[51] Int. Cl.[2] ..... E05C 1/00

[58] Field of Search ..... 292/144, 201, DIG. 32; 70/242

[56] References Cited

UNITED STATES PATENTS

| | | | |
|---|---|---|---|
| 784,644 | 3/1905 | Warner | 292/144 |
| 1,555,174 | 9/1925 | Williams | 292/144 X |
| 3,624,761 | 11/1971 | Kohn | 292/144 X |
| 3,879,969 | 4/1975 | Pynn | 70/242 |

*Primary Examiner*—Richard E. Moore

[57] ABSTRACT

The system maintains the door of a carrier of goods, such as a truck or railway car, locked when the carrier is parked and inoperative. The system includes a latch mechanism including a bolt spring biased to a latched position and a piston and cylinder mechanism coupled to the latch mechanism in such a way that air pressure applied to the cylinder moves the bolt to an unlatched position. The cylinder is connected by a conduit to a source of air pressure operated by the prime mover of the carrier and a valve mechanism is coupled to the conduit and is manually operable to vent, or supply air pressure to, the cylinder to operate the latch mechanism. When the prime mover is inoperative or disconnected and the carrier is at rest, air pressure is vented from the cylinder to latch the door to prevent theft of goods.

2 Claims, 6 Drawing Figures

PNEUMATIC DOOR LOCKING SYSTEM

BACKGROUND OF THE INVENTION

The present invention relates to a pneumatic door locking system for maintaining a door of a carrier of goods, such as a truck or railway car, in a latched condition when the carrier is stationary and the prime mover therefor is inoperative or disconnected. More specifically the system is connected to a source of pressurized air operated by the prime mover and is operative when air pressure is supplied thereto, to maintain the door in an unlatched position and when air pressure is vented or disconnected therefrom, to maintain the door in a latched position thereby to prevent theft or pilfering of goods from the carrier.

Heretofore a pneumatically actuated door locking system for a railway car door has been proposed which system is normally locked and which is operable for a limited time with a key only following operation of the air brakes for the car. Such a system is disclosed in U.S. Pat. No. 1,647,225. Also pneumatic door locking systems for automobiles have heretofore been proposed. In this respect a vaccum operated system is disclosed in U.S. Pat. No. 2,888,287 and a motor operated (air pressure operated) door latch system is disclosed in U.S. Pat. No. 1,555,174. The latter system discloses a door latch mechanism which is operable to open a vehicle door when air pressure is supplied thereto and to latch the door when air pressure is vented therefrom. This door latch mechanism functions in a manner similar to the latch mechanism of the door locking system of the present invention hereinafter described in detail. However the construction, operation and function of the door locking system of the present invention differs from the motor operated door latch disclosed in U.S. Pat. No. 1,555,174 as will become apparent from the following description of the door locking system of the present invention.

SUMMARY OF THE INVENTION

According to the invention there is provided a pneumatic door locking system which is utilized for locking a door of a carrier, such as a railway car or truck, for transporting goods and which is connected to a source of pressurized air utilized by the carrier, said system comprising means for latching the door to a door frame of the carrier, said latching means including a bolt and means for biasing the bolt toward a latched position where the door is prevented from opening, pneumatically operated means for urging said bolt to an unlatched position, means connecting said bolt urging means to the source of pressurized air and means for venting said bolt urging means to atmosphere.

DESCRIPTION OF THE PREFERRED EMBODIMENTS

Figure 1:
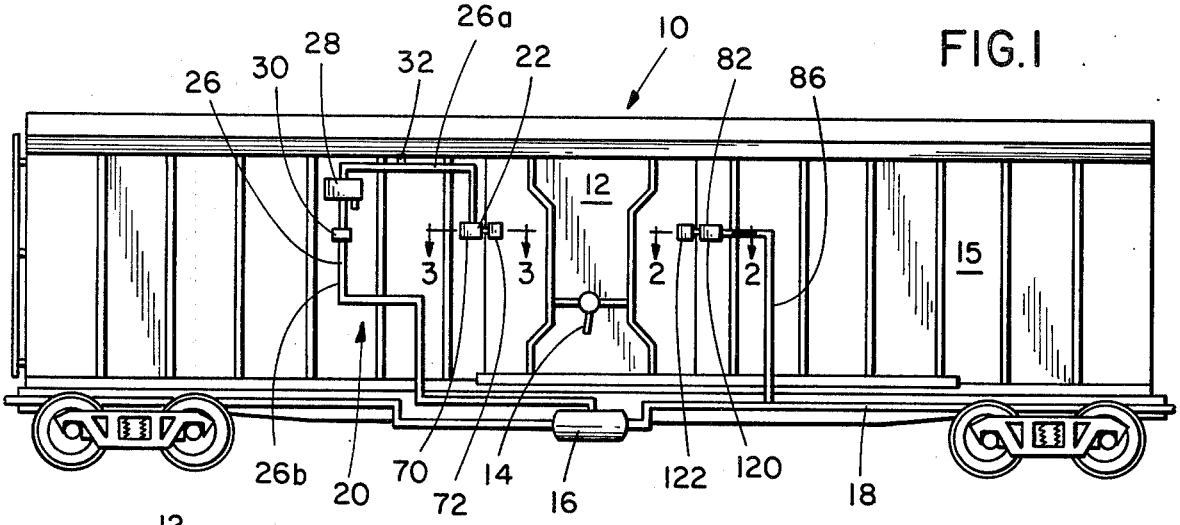
FIG. 1 is a side elevational view of a railway car with the door locking system of the invention.

Referring now to the drawings in greater detail a refrigerator type railway car is shown in FIG. 1 and identified by the reference numeral 10. The car 10 has a conventional plug door 12 with a crank 14 for moving the door 12 into and out of sealing engagement with a door frame in the side 15 of the car 10. Beneath the car 10 is an air tank 16 for operating air brakes of the car. The tank 16 is connected by a conduit 18 to a compressor (not shown) driven by an engine or locomotive when the car 10 is coupled thereto in a train of railway cars.

The locking system of the invention is generally indicated by the reference numeral 20 and includes a latch mechanism 22, a piston and cylinder mechanism 24 operatively associated with the latch mechanism 22, a conduit 26 connecting the piston and cylinder mechanism 24 (FIG. 2) with the tank 16 and a manually operable valve mechanism 28 coupled to the conduit 26 for venting the piston and cylinder mechanism 24 to atmosphere.

If desired, the valve mechanism 28 can be operable to connect and disconnect conduit section **26*a* leading to the piston and cylinder mechanism 24 with conduit section 26*b* leading to the air tank 16. Also if desired a check valve 30 can be mounted in conduit section 26*b*. Further if desired a small air bleeder 32 can be mounted in the conduit section 26*a***.

Figure 2:
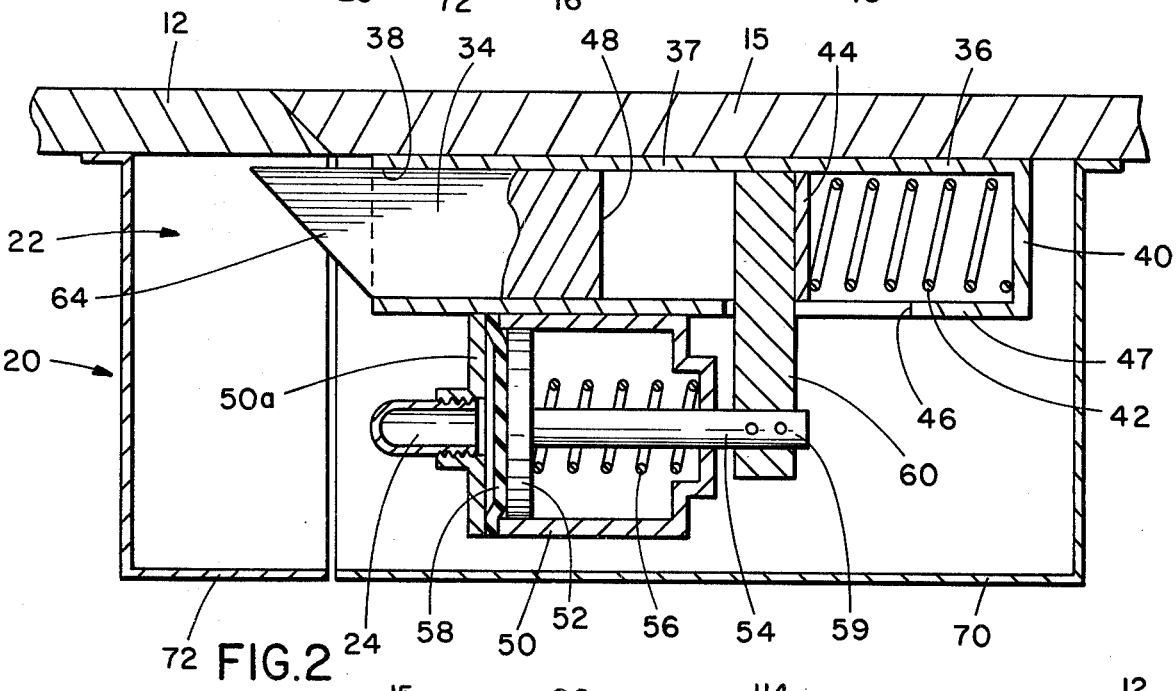
FIG. 2 is a sectional view of a door latching mechanism and is taken along line 2—2 of FIG. 1.

Referring to FIG. 2 the latch mechanism 22 includes a bolt 34 slidably received in a holder 36 having one side 37 thereof fixed to the exterior of the side 15 of the car 10 and having an open end 38 and a closed end 40 and a spring 42 between an inner end 44 of the bolt 34 and the closed end 40 for biasing the bolt 34 to a latched position. The holder 36 has a slot 46 in a side 47 thereof opposite the fixed side 37. The bolt 34 also has a slot 48 therein aligned with the slot 46.

The piston and cylinder mechanism 24 includes a cylinder 50 fixed to the holder 36, a piston 52 in cylinder 50, a piston rod 54 connected to piston 52 and extending out of the cylinder 50, a spring 56 in cylinder 50 behind piston 52 and a diaphragm 58 in cylinder 50 in front of piston 52.

As shown, conduit section **26*a* is connected to front end 50*a* of cylinder 50. The outer end of piston rod 54 identified by reference numeral 59 is connected to a bar 60 which extends into the slots 46 and 48 and is in position to engage the ends of slot 48 in bolt 34** for moving the same to a latched or unlatched position.

In the operation of the system 20 so far described, when no air pressure is present in conduit section **26*a* the springs 42 and 56 bias the bolt 34 to a latched position where an outer end 64 of bolt 34 extends over an edge of closed door 12 as shown in FIG. 2. When the railway car is connected in a train to an engine, air pressure is supplied via conduit 18 and conduit 16 to cylinder 50 and acts upon diaphragm 58 and piston 52 to push piston rod 54, bar 60 and thereby push bolt 34 to an unlatched position where the door 12 can be opened by operating crank 14**.

When the car 10 is uncoupled from the train and moved to a loading or unloading dock, or into a railroad yard pressurized air in tank 16 maintains the bolt 34 in the unlatched position through valve mechanism 28. Three or four hours after that period of time, the air pressure will have bled off through a conventional bleeder valve on tank 16. Also a pressurized air hose is usually available on the dock or in the yard for connection to conduit 18 so that the latch mechanism 22 can be placed in an unlatched condition to permit opening of door 12 for loading or unloading of the car 10.

To facilitate opening and closing of the door 12 from a loading dock, the valve mechanism 28 is mounted on the exterior of the car 10 near the top of the car 10 adjacent the door 12 and is operable to connect conduit section 26*a* to conduit section 26b to supply air pressure from tank 16 to cylinder 50. This can be done four or five times within several hours after car 10 is uncoupled from the engine before the air pressure in tank 16 is reduced to a point where it is insufficient to move bolt 34 to the unlatched position.

After conduit section 26 a is vented and bolt 34 moved to a latched position the car is moved to a railroad yard where it is securely locked.

If the system 20 includes a valve mechanism which can connect and disconnect conduit section 26*a* to 26*b* such that conduit section 26*a* can be isolated from conduit section 26*b* and is not vented via the bleeder valve of tank 16, it is desirable to have a bleeder valve in line 26*a* to bleed off air pressure from conduit section 26*a* when the car 10 is at rest.

Also with a multi function valve mechanism 28 it is desirable to have a check valve in conduit section 26*b* to minimize loss of air when the valve mechanism 28 is operated. Since the valve mechanism 28 can be any one of several known types or can consist of two valves connected in series in conduit 26 a specific valve structure has not been illustrated in the drawings.

To facilitate closing of the door 12 when the bolt 34 is in an extended position and the door 12 is open, the end 64 of bolt 34 is bevelled as shown to permit the door 12 to be pushed past bolt 34 which is momentarily pushed into holder 36 against spring 42.

Additionally, to prevent tampering with the latch mechanism 22 mating covers 70 and 72 on the door 12 and side 15 are fixed over the mechanisms 22 and 24. Also, the valve mechanism 28 is covered, but not necessarily locked, to protect it from the ambient atmosphere.

Figure 3:
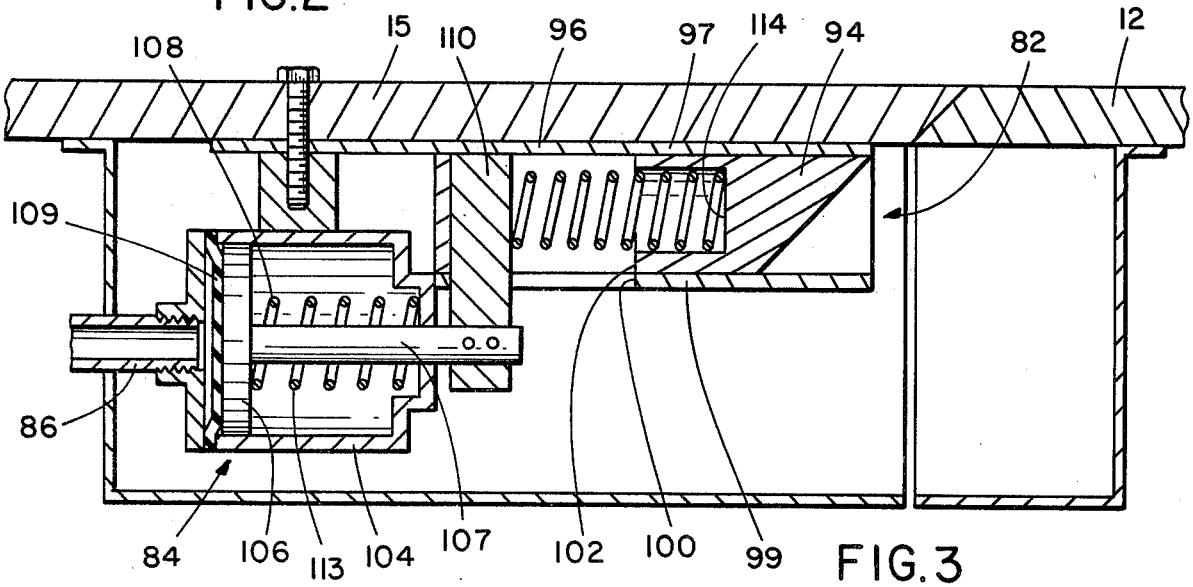
FIG. 3 is a sectional view of another door latching mechanism and is taken along line 3—3 of FIG. 1.

The system 20 can also include mechanisms for maintaining the door 12 locked while the car 10 is coupled to the engine. For this purpose a latch mechanism 82 and piston and cylinder mechanism 84 (FIG. 3) are associated with the door 12 and the frame therefor. As shown in FIGS. 1 and 3 the mechanism 84 is connected via a conduit 86 to the conduit 18 leading to the compressor. The mechanisms 82 and 84 are similar to mechanisms 22 and 24 but operate to latch the door 12 when air pressure is present in conduit 86 and to unlatch door 12 when the car 10 is uncoupled.

As shown the latch mechanism 82 includes a bolt 94 received in a holder 96 having one side 97 secured to side 15. An opposite side 99 of holder 96 has a slot 100 therein and bolt 84 has a slot 102 therein aligned with slot 100. The mechanism 84 includes a cylinder 104 fixed to side 15 of car 10, a piston 106, a piston rod 107, a spring 108 behind piston 106, a diaphragm 109 in front of piston 106 and a bar 110 connected to outer end 112 of rod 107. Like bar 60, the bar 110 extends into slots 100 and 102 for engaging bolt 94. However in this structure a biasing spring 113 is located in the slot 102 between one end of the slot 102 (in a recess 114) and the bar 110.

It will be apparent from an inspection of FIGS. 1 and 3 that the mechanisms 82 and 84 will maintain bolt 94 in a latched position only when the engine is connected to car 10 thereby to lock the door while the car 10 is still coupled just prior to uncoupling, e.g., while car 10 is in any stationary, but coupled, location.

Also as shown the mechanisms 82 and 84 are covered with covers 120 and 122.

Figure 4:
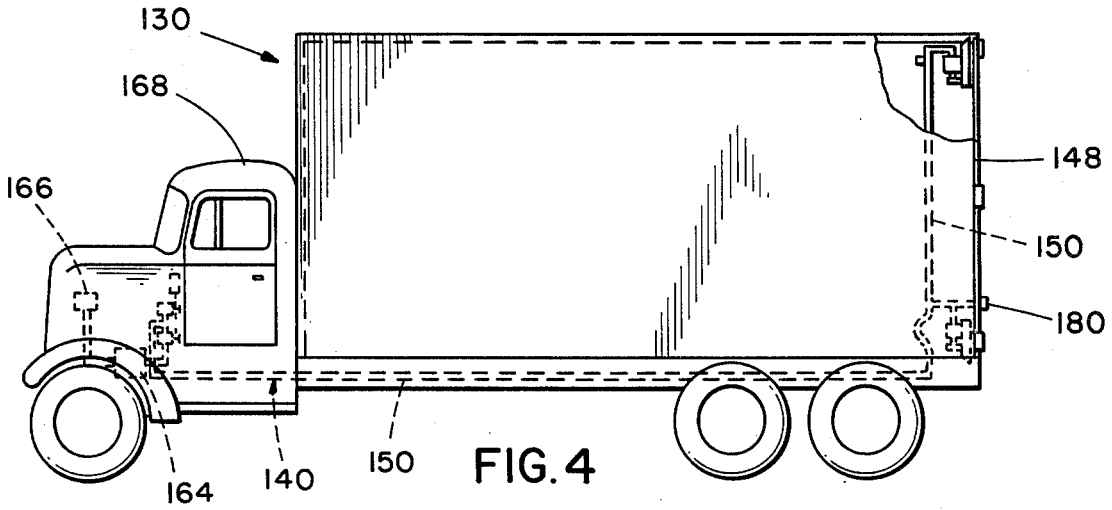
FIG. 4 is a side elevational view of a truck with another embodiment of the door locking system of the invention.
Figure 5:
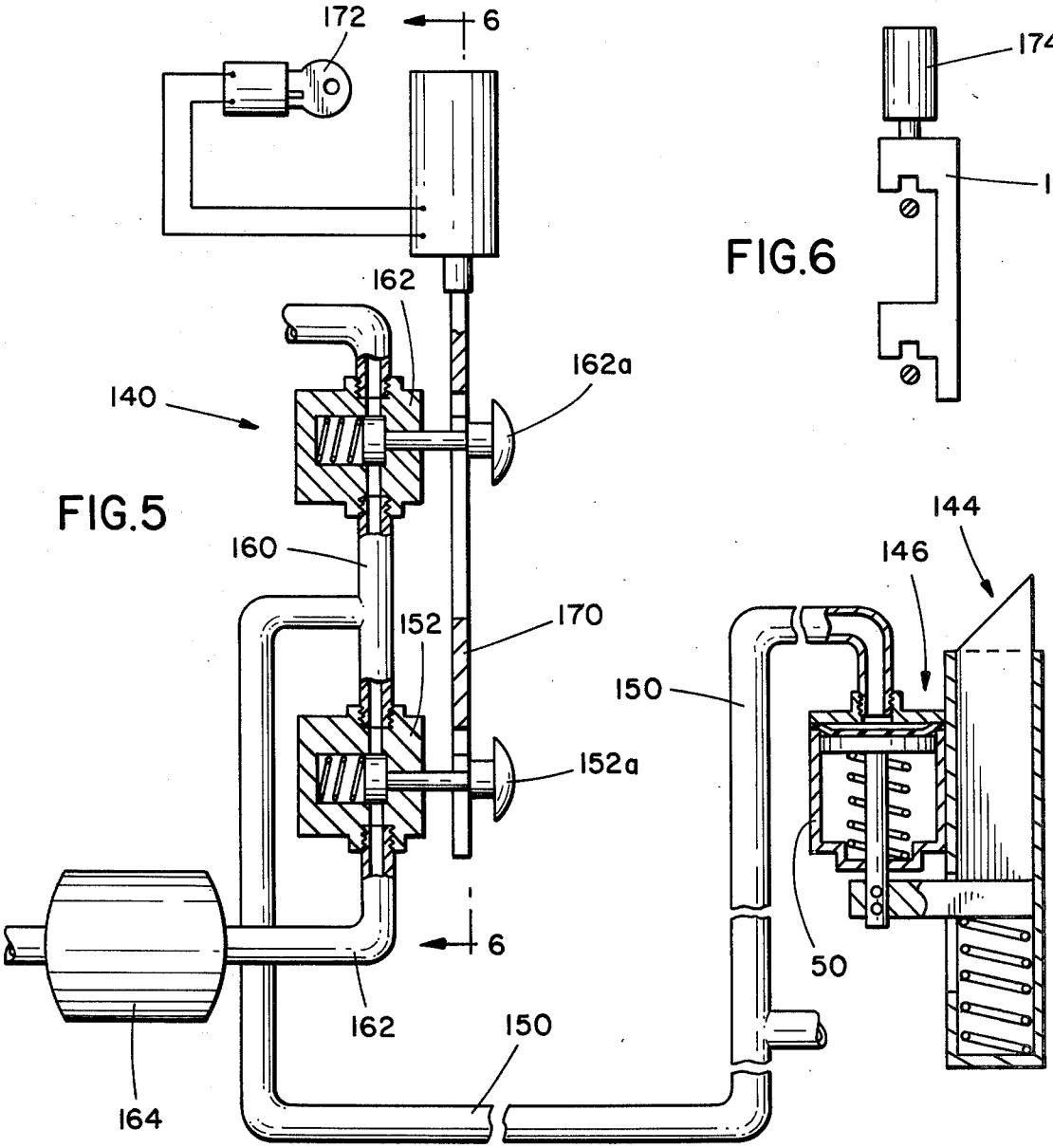
FIG. 5 is an enlarged, partially schematic, view with portions broken away of the door locking system shown in FIG. 4.
Figure 6:
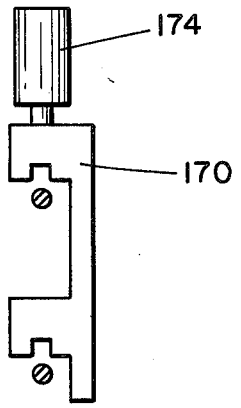
FIG. 6 is a sectional view of a solenoid operated valve locking mechanism and is taken along line 6—6 of FIG. 5.

In FIGS. 4–6 there is illustrated another embodiment of the door locking system of the invention utilized on a truck 130 and generally identified by reference numeral 140. The system 140 includes two latch mechanisms 144 each having a piston and cylinder mechanism 146 associated therewith. Since these mechanisms are identical to each other, one mounted at the top and the other mounted at the bottom on the interior side of a truck door 148, only one is shown in FIG. 5. Also, since mechanism 144 is identical to latch mechanism 22 and piston and cylinder mechanism 146 is identical to piston and cylinder mechanism 24, further description of same is omitted here and reference is made to the description of FIG. 2 and mechanisms 22 and 24 illustrated therein.

The system 140 also includes a conduit 150 connecting cylinders 50 to valve mechanism 152. Since the door 148 moves outwardly, at least a portion 156 (FIG. 4) of conduit 150 is flexible and slack. The conduit 150 is connected via a conduit 160 to a valve mechanism 162 which vents to atmosphere. The valve 152 is also connected to a conduit 162 connected to an air tank 164 charged from a compressor 166 (FIG. 4) of the truck 130.

The valve mechanisms 152 and 162 are button operated (via buttons 152*a* and 162*a*) and mounted in cab 168 of truck 130.

Preferably a solenoid operated locking bar 170 is associated with the valve mechanisms 152 and 162 and is movable under the buttons 152*a* and 162*a* to prevent operation thereof when the ignition key 172 is turned off. The solenoid is illustrated schematically and identified by reference numeral 174.

Also, preferably, a manually operated relief valve 180 is mounted on the rear of the truck and connected to conduit 150 and a small bleeder valve 182 is connected to conduit 150 at the top rear of the truck.

In operation, the ignition key 172 is turned on to unlock valves 162 and 152. Then to unlatch door 148 the operator depresses button 152*a*. After closing door 148 the operator can latch the door 148 by operating relief valve 180 or by going back inside the cab turning on the ignition and depressing button 162*a*.

Thus from the cab or from outside the truck the operator can latch the rear door 148 to prevent opening thereof.

The bleeder valve 182 insures latching of the door after the truck has been parked for a while without actuation of valve mechanism 162*a* or relief valve 180.

From the foregoing description it will be appreciated that the present invention has a number of advantages some of which have been described above and others of which are inherent in the invention. Also obvious modifications can be made to the invention without departing from the spirit or scope of the invention. Accordingly the scope of the invention is only to be limited as necessitated by the accompanying claims.

I claim:

1. A pneumatic door locking system which is intended for locking a door of a vehicular carrier intended to transport goods and which is connected to a source of pressurized air utilized by the carrier, said system comprising:

means for latching a door to a door frame of a carrier;

said latching means including a bolt and means for biasing the bolt toward a latched position in which the door is prevented from opening;

said latching means including a box-shaped holder for said bolt, said holder being open at one end and closed at the opposite end with one side of said holder being fixed to the carrier and the opposite side having a slot therein, said bolt and said biasing means being received in said holder with said biasing means disposed between said closed end of said holder and one end of said bolt and said bolt having a slot therein aligned with said slot in said holder;

pneumatically-operated means for urging said bolt to an unlatched position;

said bolt urging means including a cylinder mounted to the opposite side of said holder, a piston in said cylinder, a piston rod fixed at one end to said piston with the other end of said piston rod extending from said cylinder and being connected to a bar which extends into said slots, and a spring in said cylinder behind said piston, said connecting means being connected to said cylinder whereby air pressure is applied to the front of said piston to move said piston against said spring thereby to move said bar in said slot in the said bolt to engage and move said bolt against the biasing means to an unlatched position and whereby when air pressure is vented from said cylinder, said bolt is moved by said biasing means and said spring to a latched position;

means connecting said bolt urging means to a source of pressurized air; and manually-operated valve means disposed on the exterior of the carrier and coupled to said connecting means for venting said bolt urging means to atmosphere.

2. A system according to claim 1 wherein said means for connecting said bolt urging means to a source of pressurized air includes bleeding means for automatically bleeding off air pressure from said bolt urging means.

* * * * *